US005278742A

United States Patent [19]

Garrett

[11] Patent Number: 5,278,742

[45] Date of Patent: Jan. 11, 1994

[54] AUTOMATED TRUSS MODULE

[75] Inventor: Randall D. Garrett, Dallas, Tex.

[73] Assignee: Vari-Lite, Inc., Dallas, Tex.

[21] Appl. No.: 978,267

[22] Filed: Nov. 18, 1992

[51] Int. Cl.[5] ..... F21V 1/00

[52] U.S. Cl. ..... 362/233; 362/250; 362/239; 362/240; 362/418; 362/390

[58] Field of Search ..... 362/390, 233, 249, 250, 362/418, 238-240

[56] References Cited

U.S. PATENT DOCUMENTS 3,495,364 5/1967 De Bella .
4,167,783 9/1979 Mitchell .
4,319,311 3/1982 Mitchell .
4,523,256 6/1985 Small .
4,837,665 6/1989 Hoyer et al. .
4,862,336 8/1989 Richardson et al. .

*Primary Examiner*—Carroll B. Dority
*Attorney, Agent, or Firm*—Morgan & Finnegan

[57] ABSTRACT

An automated truss module for the support, transport and storage of lighting instruments is comprised of an upper luminaire mounting platform for mounting the lighting instruments and a separable transport support fixture. A truss section assembly, capable of being suspended above a performance area, is comprised of the upper luminaire mounting platform mounted to a section of box truss by utilizing helical isolators that provide a study cushion against shock and limit the transfer of vibration between the upper luminaire mounting platform and the box truss. The truss section assembly utilizes a motorized drive assembly to facilitate the transfer of the lighting instruments between a protected transport position, and a deployed position extending the lighting instruments below the truss section assembly for operation. Interchangeable adaptors for accommodating various types of lighting instruments are utilized for mounting the lighting instruments to the upper luminaire mounting platform. The transport support fixture may be secured by means of a latch arrangement to the upper luminaire mounting platform during transportation and storage of the truss section assembly with the mounted lighting instruments. The transport support fixture contains interchangeable head cradles that mate with the external profile of a lighting instrument in order to minimize the movement of the lighting instruments during transportation.

9 Claims, 7 Drawing Sheets

AUTOMATED TRUSS MODULE

TECHNICAL FIELD

The present invention relates generally to support structures for lighting equipment, and more particularly, to a truss system suitable for mounting and transporting lighting instruments.

BACKGROUND OF THE INVENTION

The lighting systems associated with a travelling concert tour must be easily transported from one performance venue to another. An illustrative lighting system is the Vari-Lite Series 200, with its VL2, VL3, VL4 and VL5 lamp configurations. Modern systems, often comprised of lighting instruments having sensitive optical components, are typically disassembled between performances and transported in specially designed protective containers, such as those described in copending patent application Ser. No. 940,663, filed Sep. 4, 1992, that permit the sensitive instruments to withstand the rigors associated with transport.

Accordingly, a typical lighting system, upon arrival at each performance venue, must be erected prior to each performance. To accomplish this labor-intensive task, the various sections that comprise the truss assembly must be unloaded from the truck and assembled inside the venue in the required configuration. Thereafter, the truss assembly is raised to a height of about four feet above the venue floor to facilitate the hanging of the lighting instruments on the truss assembly. Each lighting instrument must be unpacked from its protective case before being hung in its proper position on the truss assembly. Additionally, electrical cabling must be connected to the lighting instruments, and then dressed and secured to the truss members. Finally, the completed lighting rig can be hoisted to the required height above the venue floor so that construction of the stage can begin.

Although considerable savings of time and expense would clearly be achieved by transporting the lighting instruments from venue to venue mounted directly on their associated truss section, other problems are encountered using such an arrangement which, if overcome, could lead to significantly increased efficiencies in the transportation and set-up of automated lighting systems.

Specifically, in order to achieve such an advance, the truss sections must adequately protect the mounted luminaires from the damage associated with the shock and vibration experienced during transport. Additionally, the truss sections must provide for two modes of operation: a deployed mode that will expose the luminaires for operation during a performance and a transport mode that will shield and protect the luminaires. In the deployed mode, the truss section must provide each luminaire with enough clearance to allow unobstructed pan and tilt of the luminaires' moving lamp head assemblies. Furthermore, in the deployed mode the truss members should allow the luminaires to be sufficiently lowered to hang below the truss sections such that the light beams are not blocked at certain angles. In the transport mode, on the other hand, the truss section must provide the necessary protection to prevent damage to the luminaire.

"Pre-hung" truss sections have been used before in association with conventional luminaires, utilizing a sliding bar for mounting the conventional luminaire. In such a system, the truss modules are assembled in the required configuration and raised off the floor. Thereafter, a stage hand releases a manual catch which secures the mounting bar and lowers the bar to its fully deployed position where the bar rests upon stops. The lighting rig may then be raised to the required operating height. Following a performance, the rig is lowered to a working height (about four feet above the floor) and the stage hands manually raise the mounting bars until the catches engage, thereby securing the bar and the lighting instruments attached thereto inside the truss sections for transport. The absence of more sensitive optical components in these conventional luminaires has allowed these pre-hung trusses to be constructed without special attachments to secure the lighting instruments in the truss.

Automated luminaires, such as the Vari-Lite models mentioned above, however, require special protection to hold the head and yoke assemblies in a fixed relation to their upper enclosures, since a severe movement of the head and yoke with respect to the upper enclosure during transportation could cause the yoke to break. A truss unit for mounting automated luminaires is disclosed in U.S. Pat. No. 4,862,336 to Richardson et al. The disclosed "dimorphic truss unit" includes hinged side frames which can be folded up to a first position for operation of the stage lights mounted to the truss unit. The side frames can be folded down to a second position around the stage lights for protection during transportation and storage. The disclosed truss unit, however, does not include any shock mount or vibration isolation devices that would serve to protect the stage lights from damage due to vibration, nor does it include any support means for the yoke and lamp head assemblies of the stage lights installed therein.

Accordingly, it is an object of the present invention to provide a support system for lighting instruments that provides protection for the lighting instruments while traveling between performance venues and provides a motorized mechanism for deploying the lighting instruments after the truss sections are assembled and hoisted.

It is a further object of the invention to provide a support system that eliminates the requirement for separate shipping cases having cushioning material for automated luminaires, in addition to eliminating the steps of unpacking and hanging the lighting instruments before each performance.

SUMMARY OF THE INVENTION

Generally, one aspect of the invention comprises a system for supporting a multiple parameter lighting instrument, wherein the support system comprises a first member, and a second member for mounting the multiple parameter lighting instrument, the second member being coupled to the first member for extendable and retractable linear motion relative to the first member to store the lighting instrument in a protected position within the first member during transport and to support and deploy the lighting instrument in an operational position outside of the first member during a performance.

According to other features of this aspect of the invention:

1. The first member is coupled to the second member by fastening means that include damping structures for minimizing the transfer of vibration between the first member and the second member.

2. The first member can be a box truss.

3. The second member can form a lighting instrument support.

4. The system may include a third member that may be demountably secured to at least one of the first and second members, where the third member is arranged to serve as a supporting and protective component during transport.

5. The third member may include a damping structure for mating with the exterior of the lighting instrument for minimizing the movement of the lighting instrument during transport.

A second aspect of the invention comprises a support system for supporting lighting instruments within a truss section, wherein the support system comprises a lighting instrument support for mounting a lighting instrument; means coupled to the lighting instrument support for raising or lowering the lighting instrument between a protected position within the truss section and a deployed position that extends the lighting instrument outside of the truss section; and fastening means for mounting the support system to the truss section, the fastening means having damping structures for minimizing the transfer of vibration between the support system and the truss section.

According to other features of the second aspect of the invention:

1. The means for raising or lowering the lighting instrument is comprised of a motor and a drive arrangement coupled to the lighting instrument support.

2. The lighting instrument support is comprised of at least two rails coupled to the means for raising or lowering the lighting instrument, and an interchangeable mounting adaptor fastened to the rails, the adaptor being arranged to mate with one or more lighting instruments.

3. The support system may include a transportation base that may be demountably secured to the support system, where the transportation base is arranged to serve as a supporting and protective component during transport.

4. The transportation base may include a damping structure for mating with the exterior of the lighting instrument for minimizing the movement of the lighting instrument during transport.

A third aspect of the invention comprises a system for supporting and transporting a lighting instrument, wherein the system comprises a truss section, a support system for supporting lighting instruments within the truss section and a transportation base. The support system is comprised of a lighting instrument support for mounting a lighting instrument; means coupled to the lighting instrument support for raising or lowering the lighting instrument between a protected position within the truss section and a deployed position that extends the lighting instrument outside of the truss section; and fastening means for mounting the support system to the truss section, the fastening means having damping structures for minimizing the transfer of vibration between the support system and the truss section. The transportation base is comprised of fastening means for demountably securing the transportation base to the support system; and a damping structure for mating with the exterior of the lighting instrument for minimizing the movement of the lighting instrument during transport.

According to other features of the third aspect of the invention:

1. The means for raising or lowering the lighting instrument is comprised of a motor and a drive arrangement coupled to the lighting instrument support.

2. The lighting instrument support is comprised of at least two rails coupled to the means for raising or lowering the lighting instrument, and an interchangeable mounting adaptor' fastened to the rails, the adaptor being arranged to mate with one or more lighting instruments.

BRIEF DESCRIPTION OF THE DRAWINGS

A more complete understanding of the present invention may be had by reference to the following Detailed Description with the accompanying drawings, wherein.

DETAILED DESCRIPTION OF PREFERRED EMBODIMENTS

Figure 1:
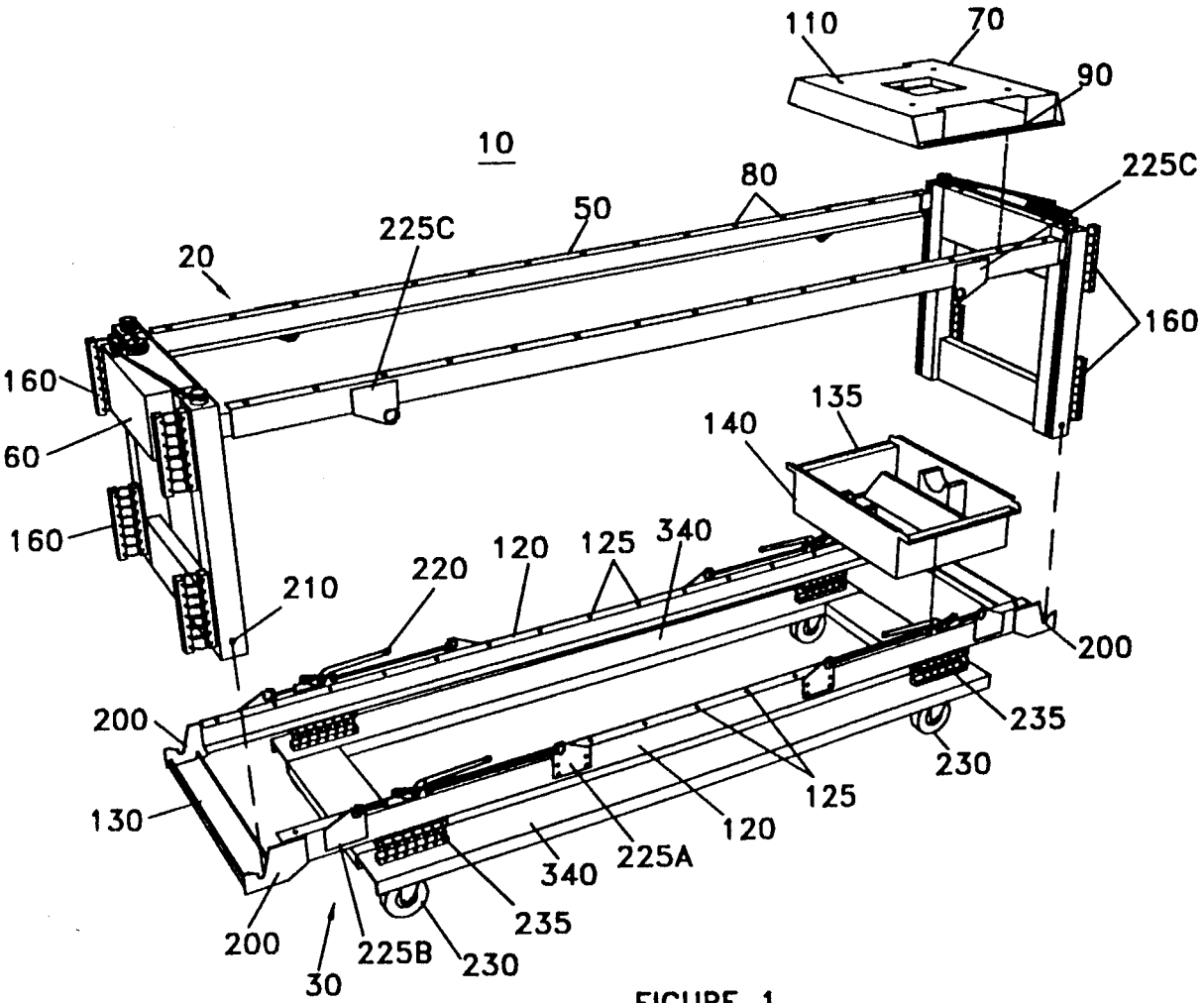
FIG. 1 is a top and left side perspective view of a support system according to the present invention.
Figure 2:
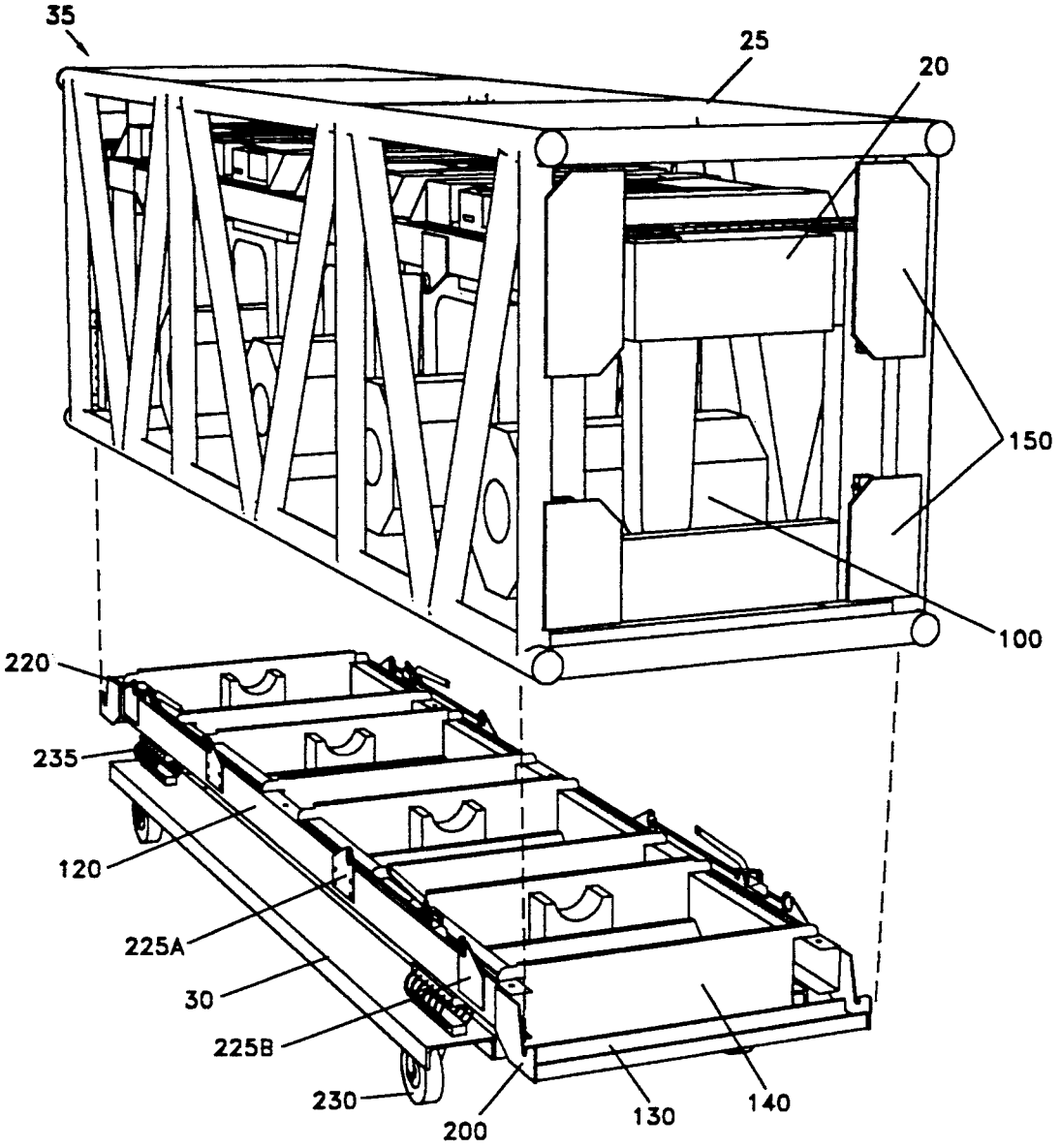
FIG. 2 is a bottom and right side perspective view of a support system according to the present invention having luminaires installed and mounted within a section of box truss.

The automated truss module 10 of the present invention, shown in FIG. 1, is comprised of an upper luminaire mounting platform 20 and a separable transport support fixture 30. As shown in FIG. 2 and discussed more fully below, a truss section assembly 35, comprised of the upper luminaire mounting platform 20 secured to a known section of box truss 25, is typically suspended from the ceiling of a performance venue with the luminaires 100 mounted to the upper luminaire mounting platform 20.

The automated truss module 10 provides for two modes of operation. In the deployed mode, shown in FIG. 3, the truss section assembly 35 is separated from the transport support fixture 30, allowing the luminaires 100 mounted to the upper mounting platform 20 of the truss section assembly 35 to extend below the truss section assembly 35 for operation. In the transport mode, shown in FIG. 4 (without box truss 25) and FIG. 5 (without installed luminaires 100), the luminaires 100 are stored within the truss section assembly 35, and the transport support fixture 30 is fastened to the upper mounting platform 20 of the truss section assembly 35 to secure the luminaires 100 for transport or storage.

The upper mounting platform 20, shown in FIG. 1 (where the box truss 25 has been removed for clarity), is comprised of two parallel mounting rails 50 connected at each end to drive assemblies 60. As will be described in further detail below, the drive assemblies 60 are operable to raise or lower the mounting rails 50.

In a preferred embodiment, an automated luminaire 100 (FIG. 3) may be mounted to the upper mounting platform 20 by means of a luminaire mounting adaptor pan 70 fastened to the mounting rails 50, as shown in FIG. 1. The adaptor pan 70 may be fastened to the mounting rails 50 by providing a plurality of mounting holes 80 in the mounting rails 50 for alignment with corresponding mounting holes 90 provided in adaptor pans 70. Preferably, the adaptor pans 70 are interchangeable on mounting rails 50 to accommodate various types of luminaires 100. Accordingly, adaptor pans 70 can be specifically designed for mating with specific luminaires 100 by constructing each adaptor pan 70 with mounting holes 110 arranged in a pattern which matches the corresponding pattern of mounting holes in the luminaire 100 for which the adaptor pan 70 is designed.

As mentioned above, the upper mounting platform 20 of the automated truss module 10 is mounted to a section of box truss 25 to form a truss section assembly 35, shown in FIG. 2. While the section of box truss 25 may be fabricated in accordance with standard construction principles, the bottom of the box truss 25 must remain clear of cross members, except at its ends, as shown in FIG. 6C, so that the luminaires 100 will not be obstructed as they are raised or lowered on the mounting rails 50. In addition, the box truss 25 is preferably constructed with mounting or gusset plates 150 (FIGS. 2 and 5) welded to each corner of the box truss 25.

Figure 4:
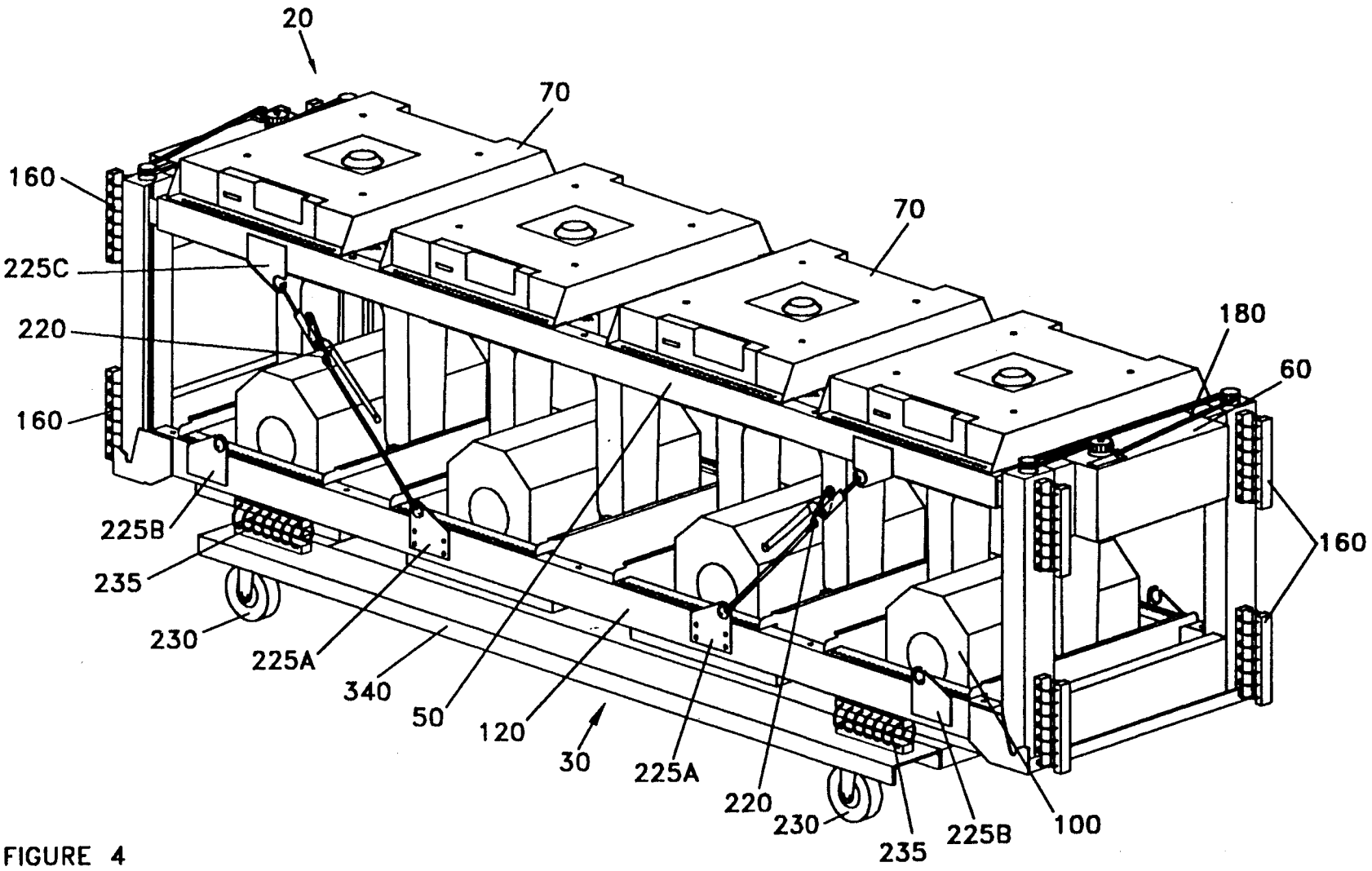
FIG. 4 is a top and right side perspective view of a support system assembled with automated luminaires installed.

Helical isolators 160 are preferably mounted on the corners of drive assemblies 60, as shown in FIGS. 1 and 4, for mounting the upper mounting platform 20 to the mounting plates 150 of the box truss 25. A helical isolator, formed by winding the length of a steel wire rope into a helix before clamping the loops of the wound wire rope between two metal mounting plates, provides a sturdy cushion against shock, and limits the transfer of vibration between the upper mounting platform 20 and the box truss 25.

In a preferred embodiment, the drive assemblies 60 of the upper mounting platform 20, used for raising or lowering the mounting rails 50, are motorized. In this embodiment, the upper mounting platform 20 consists of a motorized drive assembly 60 at each end to connect the two parallel mounting rails 50. Each motorized drive assembly 60 includes a single reversible electric motor 170 (FIG. 5) and a drive arrangement, as is known in the art, consisting of a drive belt or chain 180, plus the necessary pulleys and gears. In addition, two linear ball screws enclosed within each drive assembly 60 are connected to the drive arrangement such that the single motor 170 of the drive assembly 60 drives both ball screws. The mounting rails 50 are connected to the two balls screws such that rotation of the ball screws raises or lowers the parallel mounting rails 50.

In this manner, the two drive assemblies 60 and the two mounting rails 50 form a motorized unit which can raise or lower the mounting rails 50. The motors 170 within each of the drive assemblies 60 are preferably wired together to operate at the same time to raise or lower mounting rails 50 in synchronism. A control circuit in the motorized drive assembly 60 includes relays and limit switches, interconnected in a fashion well known in the art, to prevent overdriving the mechanism in either direction, by de-energizing the motors when mounting rails 50 are fully deployed (down) or fully retracted (up).

Electrical connectors are provided on each motorized drive assembly 60 to permit coupling to an electric power source. In addition, electrical connectors are preferably provided to permit coupling to a hand-held control box containing UP and DOWN switches, and to permit electrical coupling of one support system module to another in a daisy-chain fashion; thereby allowing a stage hand operator to use one control box to lower or raise plural support system modules at the same time.

In an alternate embodiment, the upper luminaire mounting platform 20 can be arranged in such a manner as to allow the mounted luminaires 100 to spread apart as they are lowered from the storage position to the deployed position. In this manner, storage space is optimized by storing the luminaires in a compact position within the truss section assembly 35 for transport, while providing sufficient clearance in the deployed mode to permit the luminaires 100 to pan and tilt during operation without contact with an adjacent luminaire 100.

Figure 5:
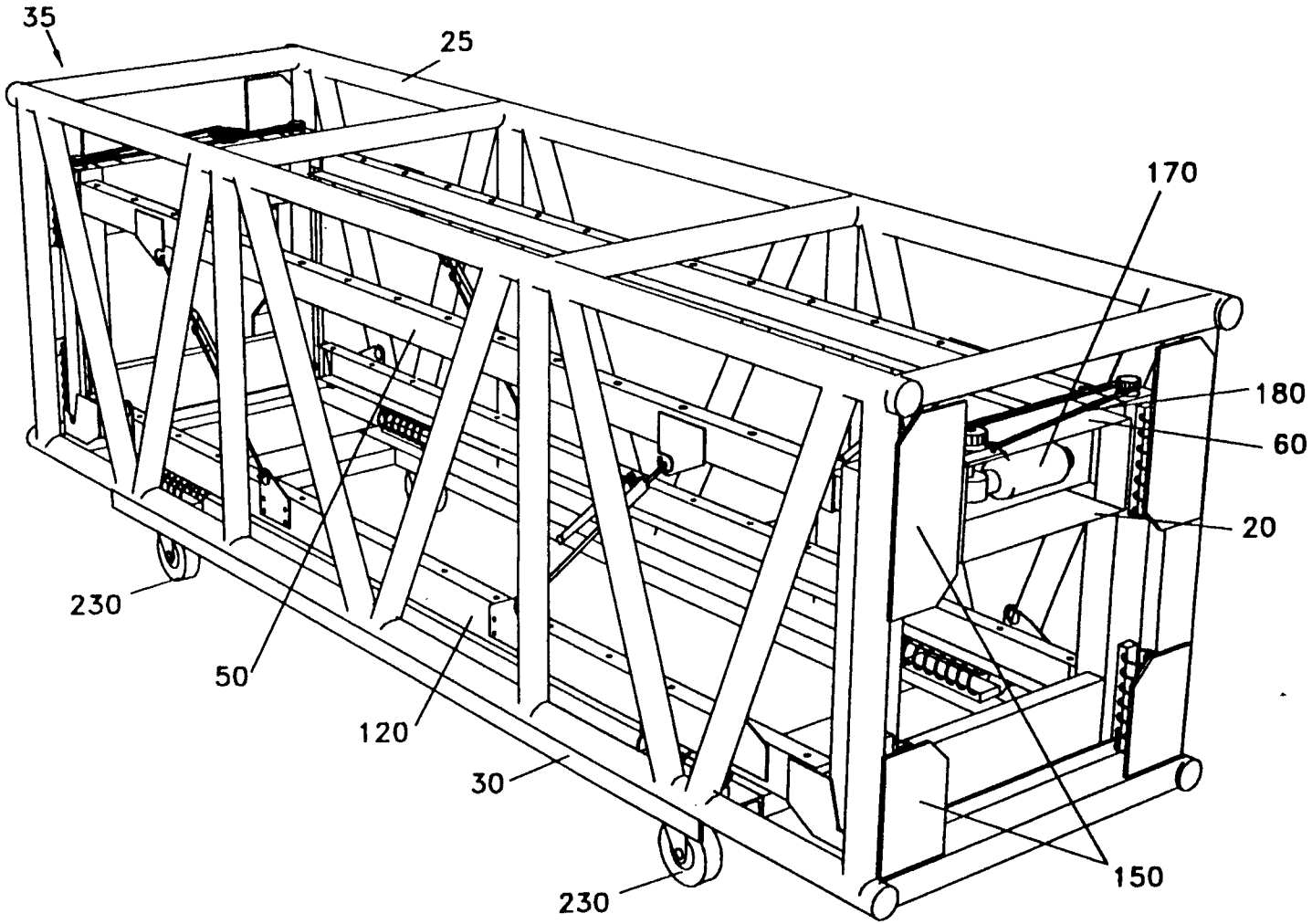
FIG. 5 is a top and right side perspective view of a support system mounted within a section of box truss.

To secure the luminaires 100 for transit within the truss module 10, the transport support fixture 30 is fastened to the bottom of the upper mounting platform 20 after retracting the luminaires 100 into the truss section assembly 35, as shown in FIGS. 4 and 5. The transport support fixture 30, shown most clearly in FIG. 1, comprises two parallel fixed mounting rails 120, connected at each end by end rails 130. Preferably, the transport support fixture 30 includes luminaire head cradles 140, fastened to the fixed mounting rails 120 by means of mounting holes 125 in the mounting rails 120 for alignment with corresponding mounting holes 135 in head cradles 140, for securing a luminaire 100 during transport.

In a preferred embodiment, a variety of head cradles 140 are interchangeable on mounting rails 120 to accommodate various types of luminaires 100. Accordingly, head cradles 140 can be specifically designed for mating with specific luminaires 100 by constructing each head cradle 140 with an interior shape that matches the external profile of the luminaire 100 for which the head cradle 140 is designed. The head cradles 140, which secure the head assembly of the lighting instruments and prevent excessive movement during transportation of the truss module, serve to limit destructive motion of the head and yoke of the luminaire 100 with respect to the upper chassis enclosure of the luminaire 100.

In order to facilitate the alignment of transport support fixture 30 with the upper mounting platform 20 during fastening, notches 200 are provided in the end rails 130. The notches 200 mate with alignment pins 210 installed in the bottom of drive assemblies 60, thereby maintaining proper alignment of the transport support fixture 30 with upper mounting platform 20.

To secure the transport support fixture 30 to the truss section assembly 35, latches 220 are provided at each of the four corners of the transport support fixture 30. When the transport support fixture 30 is separated from the truss section assembly 35 for storage during a performance, the latches 220 are placed in their storage positions, i.e., coupled to hooks 225A and 225B, as shown in FIG. 1. When the transport support fixture 30 is to be secured to truss section assembly 35 for transport and storage, the latches 220 are placed in their fastened position, i.e., coupled to hooks 225A and 225C, as shown in FIG. 4.

As shown in FIG. 5, casters 230 can be provided on the bottom of the transport support fixture 30 to facilitate movement of the assembly, which can weigh up to 400 pounds when mounted with four large luminaires 100. In the preferred embodiment, the two parallel fixed mounting rails 120 of the transport support fixture 30 are secured by means of four helical isolators 235 to the two parallel base rails 340 riding upon casters 230, as shown in FIGS. 1 and 4. As noted above, the helical isolators 235 provide a sturdy cushion against shock, and limit the transfer of vibration.

In preparation for a stage show or other performance event, the truss section assembly 35 containing automated luminaires 100 mounted in upper mounting platform 20 is attached to support cables (not shown) in a manner well known in the entertainment lighting industry. Latches 220 are released from hooks 225C and coupled to hooks 225B, to place the latches 220 in their storage position, as described above. Since the transport support fixture 30 is no longer fastened to the truss section assembly 35, the truss section assembly 35 can be raised, leaving the transport support fixture 30 on the venue floor as shown in FIG. 2.

Figure 3:
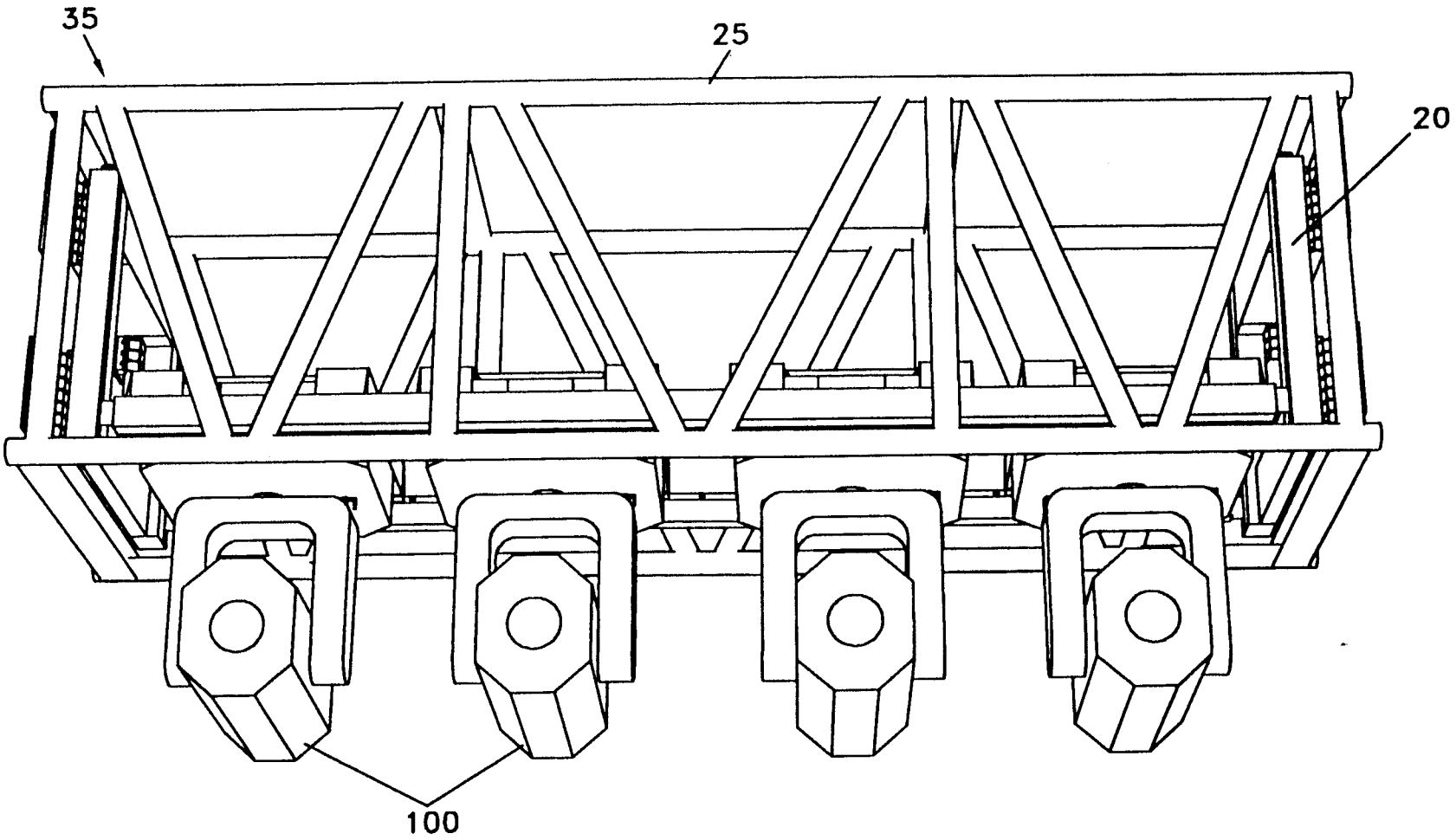
FIG. 3 is a bottom and front perspective view of a support system mounted within a section of box truss, showing the installed luminaires deployed in an operating position.

Once a stage hand operator has connected the various electrical cables to the luminaires 100, and to the support system drive assemblies 60, including the control box (not shown), the operator may press the DOWN button to deploy the luminaires 100 as shown in FIG. 3. When the luminaires are fully deployed, the control box (not shown) can be disconnected or stored in the truss section assembly 35, and the truss section assembly 35 can be raised to the desired height above the stage.

The truss section assembly 35 can also be used in an inverted position so that the drive assemblies 60 raise the luminaires 100 up out of the truss section assembly 35 for use and retract the luminaires 100 into the truss section assembly 35 for storage. Alternatively, the truss section assembly 35 can be used vertically so that the drive assemblies 60 extend the luminaires 100 sideways out of the truss section assembly 35.

Figure 7:
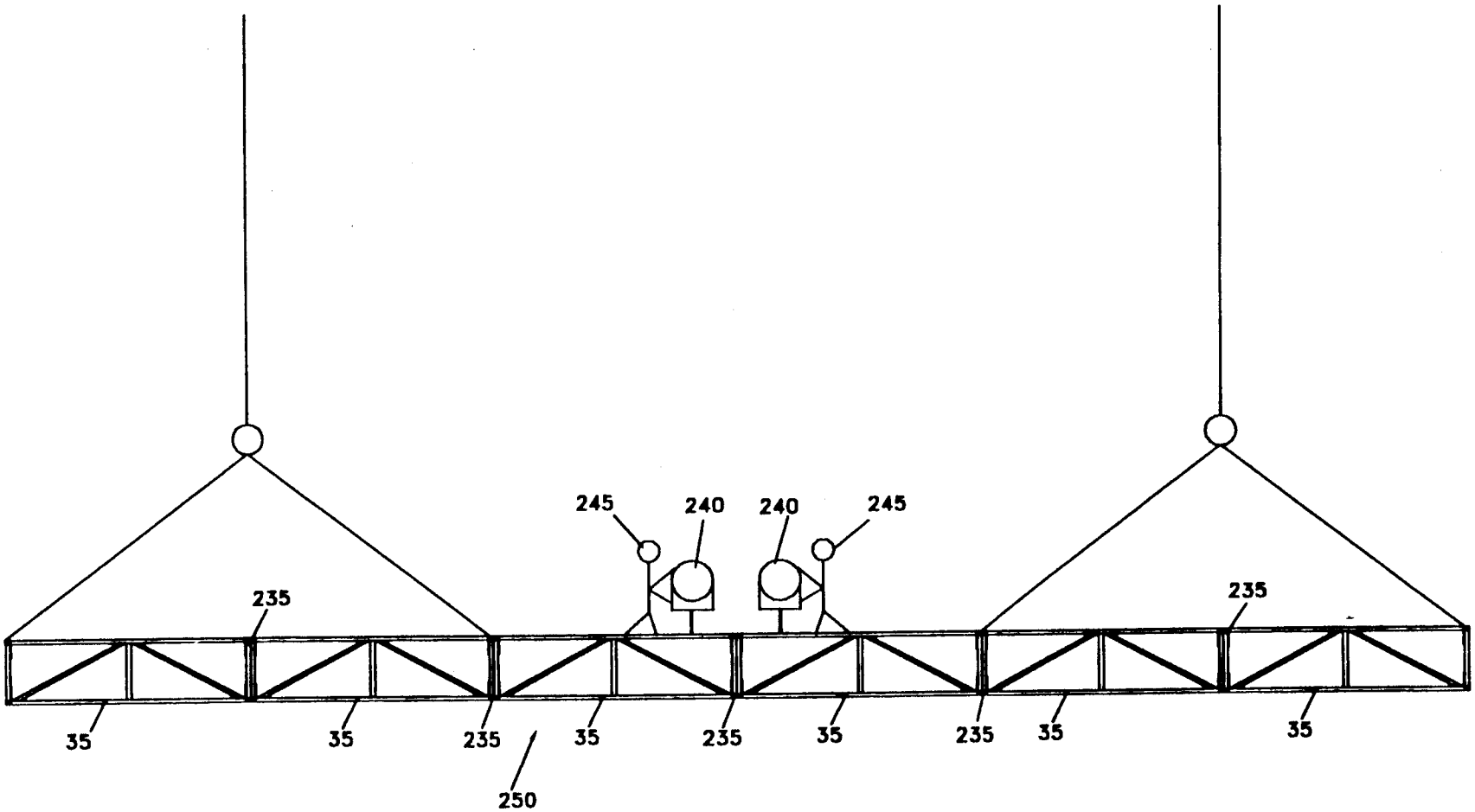
FIG. 7 is a front view of a truss structure comprised of six truss section assemblies coupled end-to-end.

As is known in the art, the truss section assembly 35 can include coupling provisions 235 at each end so that sections of box truss 25 can be fastened together end-to-end. In this manner, an entire truss structure 250 can be constructed, as shown in FIG. 7. In a typical configuration, 6 truss section assemblies 35, each having a length of about 105 inches, would be coupled together end-to-end by providing nesting truss members at each end that may be interlocked with an adjacent truss section assembly 35 by inserting a pin through the nested ends to construct a truss structure of about 52 feet long. For a truss section assembly 35 having a length of 105 inches, four large automated luminaires 100, five medium-sized automated lighting instruments, ten small instruments, or a mixture thereof can be mounted.

Figure 6A:
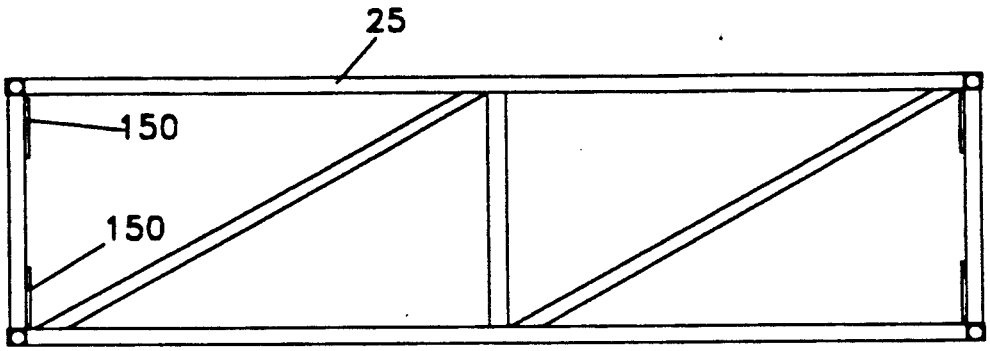
FIGS. 6A, 6B and 6C are top, side and bottom views, respectively, of a section of box truss.
Figure 6B:
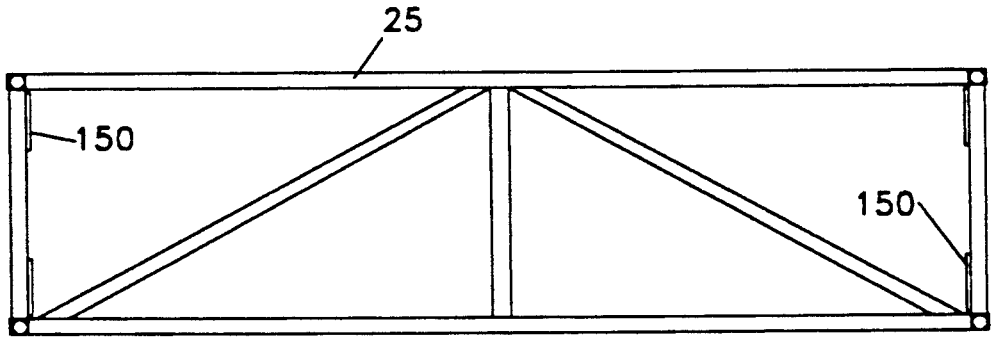
Figure 6C:
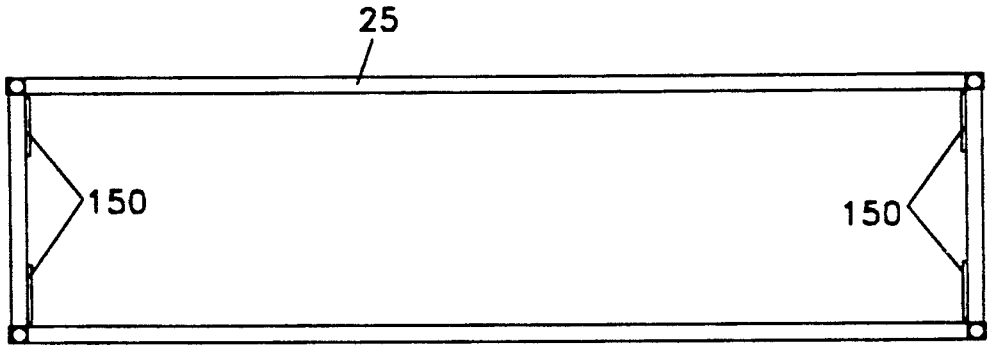

When the upper mounting platform 20 of the automated truss module 10 is mounted to a section of box truss 25 constructed of cord tubing having a diameter of not more than 2 inches and having the configuration shown in FIGS. 6A (top view), 6B (right and left side views) and 6C (bottom view), the resulting truss section assembly 35 weighs approximately 150 pounds, including the weight of the upper mounting platform 20. If a maximum equipment load of 400 pounds per truss section assembly 35 is specified, each truss section assembly 35 must support a maximum total weight of 525 pounds.

As shown in FIG. 7, it is often desirable to position spot lights 240 and spot light operators 245 on the top of the truss structure 250 during a performance. A pair of spot light operators 245 (200 pounds each) and their corresponding spot light equipment 240 (200 pounds each) result in an added load of 800 pounds. Accordingly, a truss structure 250 comprised of six truss section assemblies 35 and a pair of spot light operators 245 and their corresponding spot light equipment 240, must support a total load of 3950 pounds.

We claim:

1. A system for supporting a plurality of multiple parameter lighting instruments, said system comprising:

means forming a box truss;

means mounting said plurality of lighting instruments within said box truss; and means including a drive assembly for moving said mounting means so that said plurality of lighting instruments can be positioned either externally of said truss or withdrawn within said box truss for protection as desired.

2. The system according to claim 1, wherein said box truss is coupled to said mounting means for said lighting instrument by fastening means that include dampening structures for minimizing the transfer of vibration between said box truss and said mounting means for said lighting instruments.

3. The system according to claim 1, wherein said mounting means for said lighting instruments forms a lighting instrument support.

4. The system according to claim 1, wherein said drive assembly is motorized.

5. The system according to claim 1, wherein said mounting means for said lighting instruments is comprised of at least two rails coupled to said drive assembly, and an interchangeable mounting adaptor fastened to said rails, said adaptor being arranged to mate with one or more lighting instruments.

6. The system according to claim 1, further including a transportation base that may be demountably secured to said system for supporting a plurality of lighting instruments, where said transportation base is arranged to serve as a supporting and protective component during transport.

7. The system according to claim 6, wherein said transportation base includes a damping structure for mating with the exterior of said lighting instrument for minimizing the movement of said lighting instrument during transport.

8. A system according to claim 2, further including a transportation base comprised of:

fastening means for demountably securing said transportation base to said support system; and a damping structure for mating with the exterior of said lighting instrument for minimizing the movement of said lighting instrument during transport.

9. The system according to claim 1, wherein said mounting means for said lighting instruments is coupled to said box truss for extendable and retractable linear motion relative to said box truss.

* * * * *